US006684670B1

(12) United States Patent
Agbay et al.

(10) Patent No.: US 6,684,670 B1
(45) Date of Patent: Feb. 3, 2004

(54) LOCK ASSEMBLY WITH SELF RETAINED BARREL LOCK

(75) Inventors: Anthony J. Agbay, Auburn, MA (US); John Mahaney, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 0 days.

(21) Appl. No.: 10/214,224

(22) Filed: Aug. 7, 2002

(51) Int. Cl.[7] ..... A45C 13/10

(52) U.S. Cl. ..... 70/164; 70/14; 70/226; 70/233; 70/32; 70/33; 70/34; 70/386

(58) Field of Search ..... 70/14, 226, 233, 70/32, 34, 164, 386

(56) References Cited

U.S. PATENT DOCUMENTS

| | | | | | |
|---|---|---|---|---|---|
| 1,234,212 | A | * | 7/1917 | Renaux | 70/386 X |
| 1,499,444 | A | * | 7/1924 | Caillois | 70/386 X |
| 3,002,368 | A | | 10/1961 | Moberg | 70/14 |
| 3,033,016 | A | | 5/1962 | Moberg | 70/395 |
| 3,835,674 | A | * | 9/1974 | Hoyt | 70/34 |
| 3,861,180 | A | * | 1/1975 | Heckrotte, Sr. et al. | 70/164 |
| 4,008,585 | A | | 2/1977 | Lundberg | 70/164 |
| 4,063,434 | A | | 12/1977 | Moberg | 70/34 |
| 4,158,953 | A | | 6/1979 | Nielsen, Jr. | 70/164 |
| 4,415,190 | A | * | 11/1983 | Finck, Jr. et al. | 292/256.6 |
| 4,614,097 | A | * | 9/1986 | Signorelli | 70/34 |
| 4,793,164 | A | | 12/1988 | Sloop, Sr. | 70/164 |
| 4,807,454 | A | * | 2/1989 | Sengupta et al. | 70/386 X |
| 4,823,572 | A | * | 4/1989 | Signorelli | 70/163 |
| 4,946,130 | A | | 8/1990 | Kooiman | 70/176 X |
| 5,050,413 | A | | 9/1991 | Stillwagon | 70/386 |
| 5,354,076 | A | | 10/1994 | Yeo et al. | 279/110 |
| 5,492,206 | A | | 2/1996 | Shieh | 70/233 X |
| 5,515,947 | A | | 5/1996 | Shieh | 70/32 X |
| 5,542,273 | A | | 8/1996 | Bednarz | 70/34 |
| 5,829,280 | A | * | 11/1998 | Chen | 70/386 X |
| 6,406,074 | B1 | * | 6/2002 | Mahaney | 292/327 |
| 6,467,751 | B1 | * | 10/2002 | Korpanty et al. | 251/90 |
| 6,574,999 | B2 | * | 6/2003 | Chen | 70/33 |
| 2003/0015007 | A1 | * | 1/2003 | Zapushek et al. | 70/386 |

* cited by examiner

*Primary Examiner*—Suzanne Dino Barrett
(74) *Attorney, Agent, or Firm*—Samuels, Gauthier & Stevens

(57) ABSTRACT

A security device comprises a first component having a through first passageway surrounded by an internal first recess, and a second component having a second passageway surrounded by an internal second recess. The first and second components are configured for assembly in a mating relationship with the first and second passageways in communication with each other and in coaxial alignment. A lock has a barrel containing a spring and plunger and carrying radially shiftable locking elements, with the plunger being normally biased by the spring in one direction urging the locking elements into expanded positions protruding radially from the barrel. The barrel is insertable into and releasably retained in an unlocked position in the first passageway with the locking elements expanded radially outwardly into the first recess, and is shiftable by a forwardly applied axial force into a locked position in the second passageway with the locking elements expanded into the second recess. The first recess has a forward surface configured to coact with the locking elements in response to the forwardly applied force to exert a reactionary force urging the locking elements radially inwardly and urging the plunger in the opposite direction to accommodate retraction of the locking elements from the first recess.

3 Claims, 5 Drawing Sheets

LOCK ASSEMBLY WITH SELF RETAINED BARREL LOCK

BACKGROUND OF THE INVENTION

1. Field of the Invention

This invention relates generally to lock assemblies incorporating barrel locks, and is concerned in particular with the self retention of the barrel locks in the lock assemblies when in the unlocked state. Such lock assemblies are widely employed by public utilities to secure meters, supply conduits, etc. against unauthorized access.

2. Description of the Prior Art

The metering mechanism of a conventional utility meter is typically enclosed within a transparent cover removably mounted to the lid of a box-shaped housing. The cover and lid have confronting circular rims which are held in an axially aligned abutting relationship by a split retaining ring in combination with a barrel lock.

The split retaining ring has a generally channel-shaped side wall curving from one end containing an internal bushing to another end provided with a cylindrical external collar. The internal bushing and external collar comprise components of a lock assembly configured for use with a barrel lock. The retaining ring may either be resiliently deformable or hinged to accommodate its adjustment between an enlarged condition for installation on and removal from the confronting meter rims, and an installed constricted condition which radially and axially confines the confronting meter rims within the channel-shaped ring wall. When the ring is in its enlarged condition, the internal bushing and the external collar on its opposite ends are out of alignment and lie on parallel axes. When the ring is constricted to its installed condition, the opposite ring ends are brought together with the internal bushing and external collar aligned coaxially and in communication with each other. The barrel lock is then inserted into the communicating coaxially aligned collar and bushing to retain the ring in its constricted condition. The barrel lock has radially shiftable locking balls which coact in interengagement with an inner recess in the internal bushing to prevent unauthorized removal of the lock. The locking balls are urged radially outwardly by a spring loaded plunger. A specially designed key is employed to axially retract the plunger allowing the locking balls to retract radially into the lock barrel to thereby accommodate insertion and removal of the lock into and out of its locked position. Barrel locks are similarly employed to releasably assemble mating components in dead bolt assemblies, cap and plug locks, etc.

There are several problems with the manner in which barrel locks are currently employed. In many cases, the barrel locks are supplied as separate components which must be assembled on site. This complicates installation and can lead to locks being misplaced or lost. Secondly, a key must be employed to assemble the locks with their associated lock components. This requires widespread distribution of keys to installation personnel, which in turn increases the danger that keys will be lost or stolen, thereby seriously compromising overall system security.

In order to counteract these problems, several lock suppliers, including the assignee of the present invention, have sought to develop lock assemblies with barrel locks that are preassembled and temporarily retained in a retracted unlocked position, with only an externally applied force being required to advance the locks into the locked position.

A decided drawback with these arrangements, however, has been the perceived need on the part of those skilled in the art to specially machine and configure the lock barrels to mechanically interengage in the unlocked position with other components of the lock assembly. In some cases, the other lock components are "extra", i.e., in addition to those conventionally employed in standard lock assemblies.

Thus, at the manufacturing level, costs are disadvantageously increased by the need to specially machine and configure the lock barrels, and/or to incorporate extra components into the lock assembly.

At the user level, where conventional lock assemblies and barrel locks are already in use, the introduction of barrel locks with specially configured barrels requires both types of locks to be maintained in inventory for use by installation and maintenance personnel, thus disadvantageously complicating the overall administration of a security system.

SUMMARY OF THE PRESENT INVENTION

The present invention proceeds from the realization that contrary to conventional wisdom, it is not necessary to specially configure the lock barrels, or to employ extra lock components, in order to temporarily retain the barrel locks in a retracted unlocked position. Instead, this function can be assigned to the locking balls of a standard barrel lock acting in concert with an appropriately configured and positioned internal recess in a standard lock collar. By doing do, manufacturing costs are not adversely impacted, and users are not saddled with the problems associated with maintaining and employing an inventory of different barrel locks.

These and other objectives and advantages of the present invention will become more apparent as the description proceeds with the aid of the accompanying drawings, wherein:

DETAILED DESCRIPTION OF PREFERRED EMBODIMENT

Figure 1:
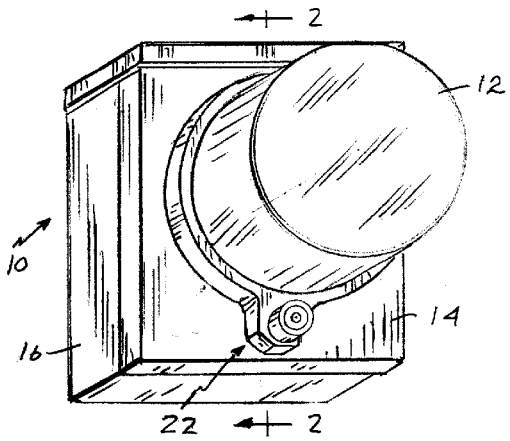
FIG. 1 is a perspective view of a typical meter installation incorporating a split retaining ring and barrel lock combination in accordance with the present invention.
Figure 2:
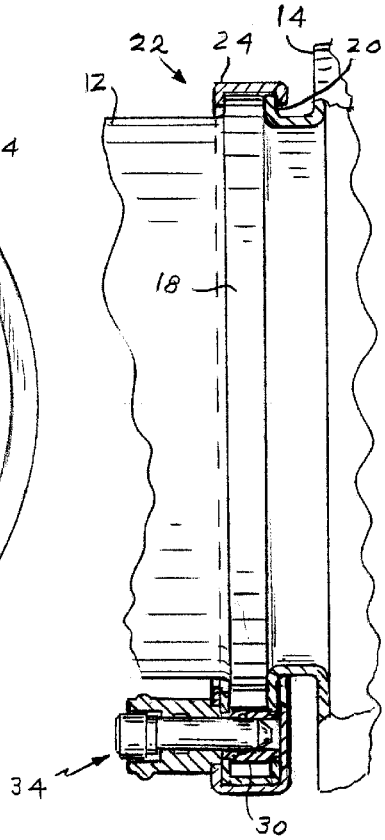
FIG. 2 is a sectional view on an enlarged scale taken along line 2—2 of FIG. 1.

Referring initially to FIGS. 1 and 2, a utility meter employing a split retaining ring incorporating a lock combination in accordance with the present invention is generally depicted at 10. The metering mechanism (not shown) is enclosed by a glass cover 12 removably mounted to the lid 14 of a box-shaped housing 16. The cover and lid are provided respectively with confronting circular rims 18, 20. A split retaining ring 22 is employed to secure the rims 18, 20 in an axially aligned abutting relationship.

Figure 4:
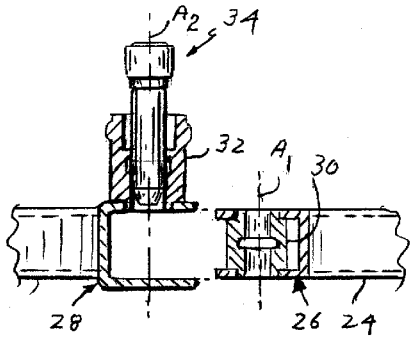
FIG. 4 is a sectional view taken along line 4—4 of FIG. 3.
Figure 3:
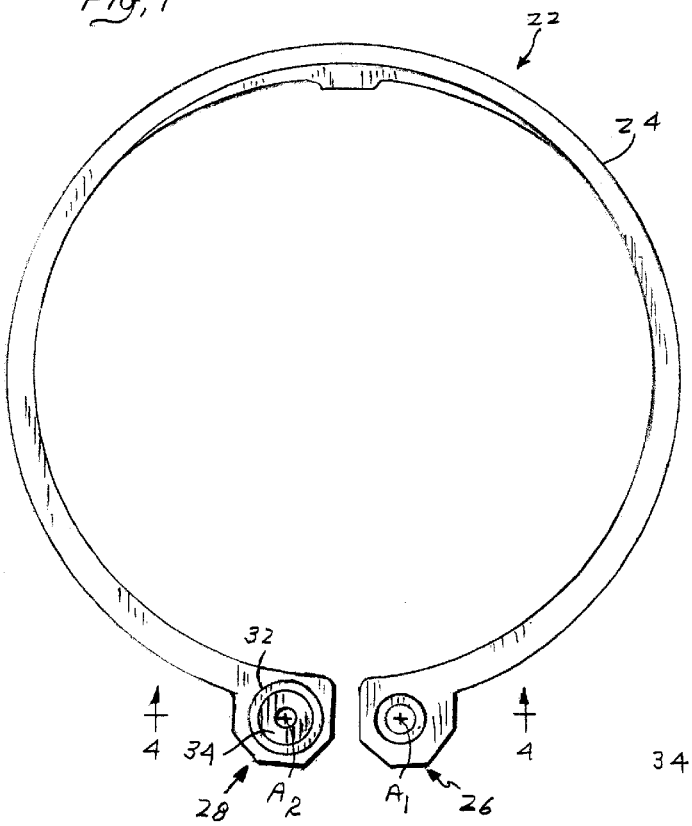
FIG. 3 is a front elevational view of the split retaining ring and barrel lock combination of FIGS. 1 and 2, with the ends of the ring spread apart.

With reference additionally to FIGS. 3 and 4, it will be seen that the split retaining ring 22 has a generally channel-shaped side wall 24 curving from a male end 26 to a female end 28. A bushing 30 is contained in the male end 26, and an exterior tubular collar 32 is secured to the female end 28. The split ring is resiliently adjustable between an enlarged condition as shown in FIGS. 3 and 4, which accommodates its installation on and removal from the rims 18, 20, and a constricted condition as shown in FIGS. 1 and 2, where the rims 18, 20 are both radially and axially confined by the channel-shaped side wall 24. In the condition shown in FIGS. 3 and 4, the bushing 30 and collar 32 lie on parallel axes $A_1$, $A_2$, whereas in the constricted condition as shown in the remaining drawings, the bushing 30 and collar 32 are aligned coaxially and in communication one with the other.

A barrel lock 34 serves as the means for maintaining the ring in its constricted condition. As can best be seen in FIGS. 5–7, the barrel lock includes a head 36 with a cylindrical barrel 38 extending axially therefrom. The barrel has an internal passageway 40 leading to a reduced diameter blind bore 42. Locking balls 44 are located in radial openings communicating with the bore 42. A plunger 46 is contained within the barrel 38. The plunger has a specially shaped nose 48 at one end surrounded by a sleeve 50 fixed within the barrel, and a reduced diameter stem 52 projecting between the locking balls 44 from a shoulder 54. An enlarged collar 56 on the plunger is acted upon by a helical compression spring 58 retained in the barrel 38 by the sleeve 50.

Figure 5:
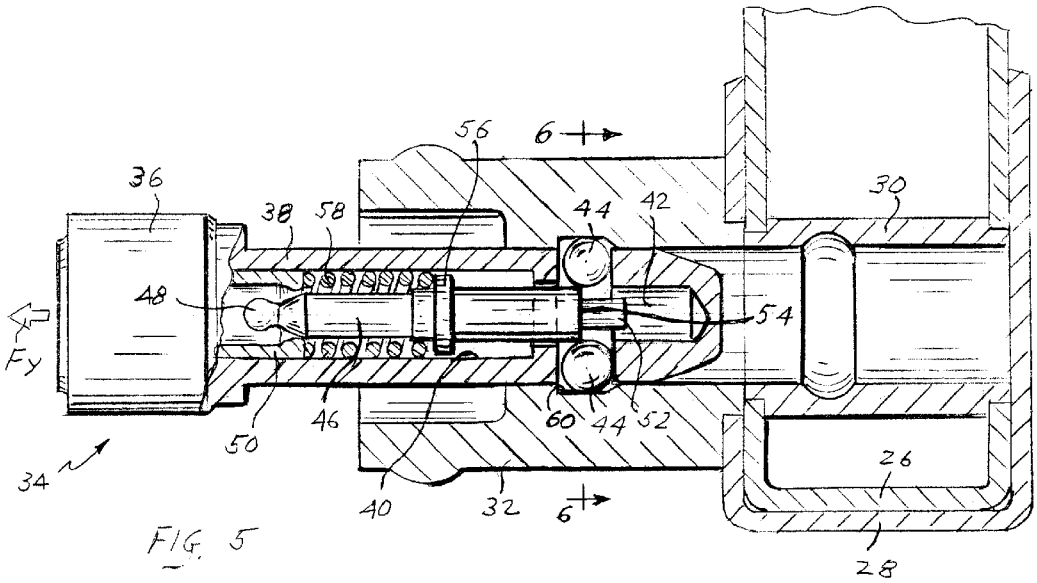
FIG. 5 is an enlarged sectional view showing the male and female ends of the split retaining ring in axial alignment prior to insertion of the lock into its locked position.
Figure 6:
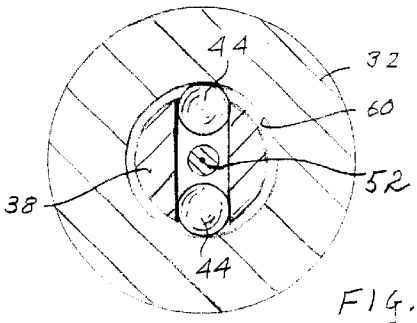
FIG. 6 is a sectional view on an enlarged scale taken along line 6—6 of FIG. 5.
Figure 8:
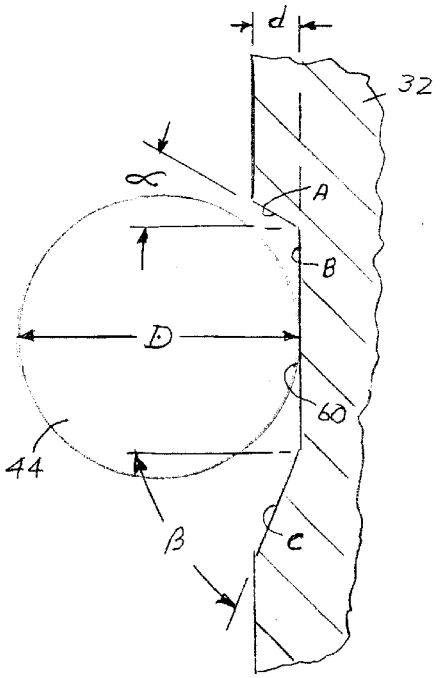
FIG. 8 is an enlarged diagrammatic view depicting one of the locking balls seated in the internal recess of the lock collar.

When the barrel lock is in its retracted unlocked position as shown in FIGS. 5 and 6, the locking balls 44 are urged radially outwardly into a recess 60 in an interior wall of the collar 32. As can best be seen in FIG. 8, the recess 60 has a relatively steeply inclined back wall A, a bottom B, and a front ramp-like wall C. Wall A defines an angle $\alpha$, with respect to a reference plane perpendicular to the bottom wall B, and wall C similarly defines an angle $\beta$. The depth "d" of the recess 60 is preferably between about 15 to 30% of the ball diameter "D".

During initial assembly of the lock, the plunger 46 is retracted against the biasing action of the spring 58. Plunger retraction is effected by using a special key (not shown) designed to grip the plunger nose 48. This accommodates radial retraction of the locking balls 44 inwardly against the reduced diameter stem 52 of the plunger. Once the barrel 38 is received in the collar as shown in FIG. 5, the key is disengaged from the nose 48. The resilient force of the spring 58 acts on the collar 56 to urge the plunger 46 forwardly, and the plunger acts through its shoulder 54 to urge the locking balls 44 radially outwardly into the recess 60 to thereby releasably retain the lock in an unlocked position.

Figure 9:
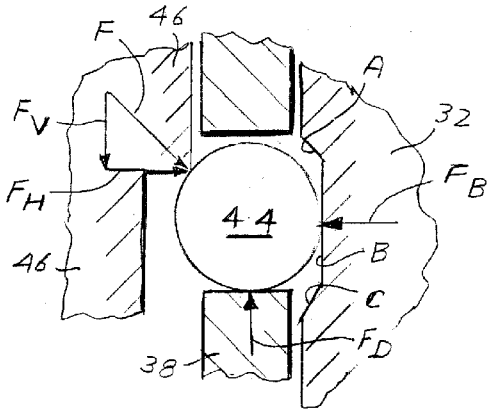
FIGS. 9–11 are diagrammatic views depicting the forces acting on the locking balls at different stages.

With reference to FIG. 9, when the lock is in its unlocked position, the plunger force F on the balls may be resolved into vertical and horizontal components $F_V$ and $F_H$. The balls 44 are in a state of equilibrium, with the horizontal force component $F_H$ opposed by an equal and opposite reactionary force $F_B$ exerted by the bottom wall B of recess 60, and with the vertical component $F_V$ opposed by an equal and opposite reactionary force $F_D$ exerted by the lock barrel 38.

Figure 7:
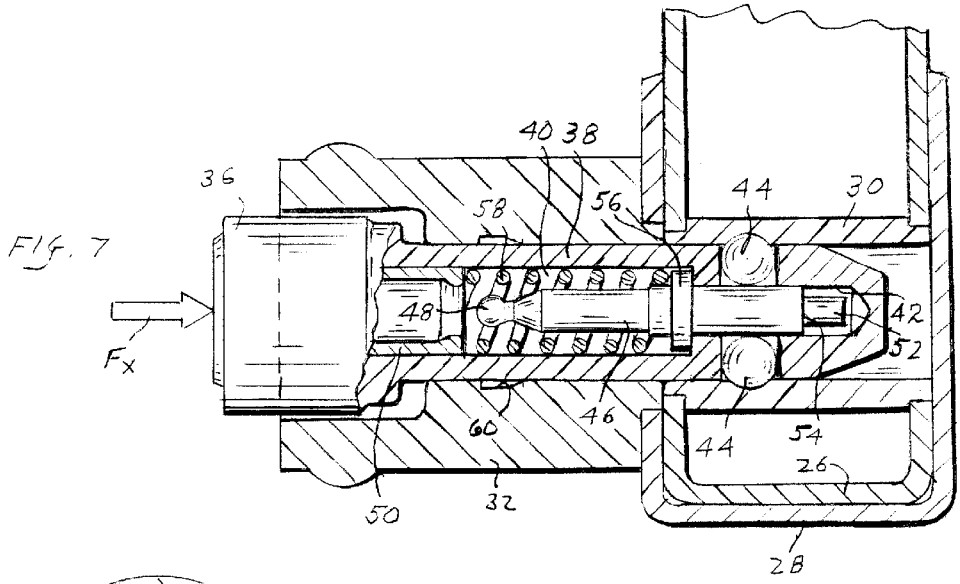
FIG. 7 is a view similar to FIG. 5 showing the lock in its locked position.

Once the collar 32 and bushing 30 have been brought into coaxial alignment, the lock may be advanced from its unlocked position as shown in FIG. 5 to its locked position as shown in FIG. 7 by an axially directed external force $F_X$.

Figure 10:
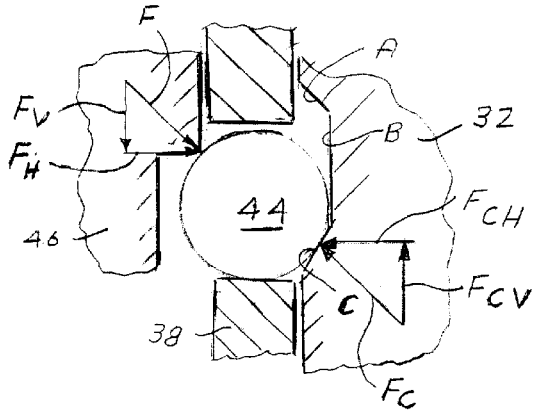

As the lock is advanced, and as shown in FIG. 10, each ball 44 encounters front wall C and its continued forward motion is opposed by a reactionary force $F_C$, which may be resolved into horizontal and vertical components $F_{CH}$ and $F_{CV}$. A state of equilibrium continues as long as the horizontal component $F_{CH}$ of reactionary force $F_C$ is equal to $F_H$, and the vertical component $F_{CV}$ is equal to $F_V$. When the externally applied force $F_X$ produces a horizontal reactionary force component $F_{CH}$ that exceeds $F_H$, the locking balls 44 are retracted radially from the recess 60 into the barrel 38, allowing the lock to move forward to the locked position.

Figure 11:
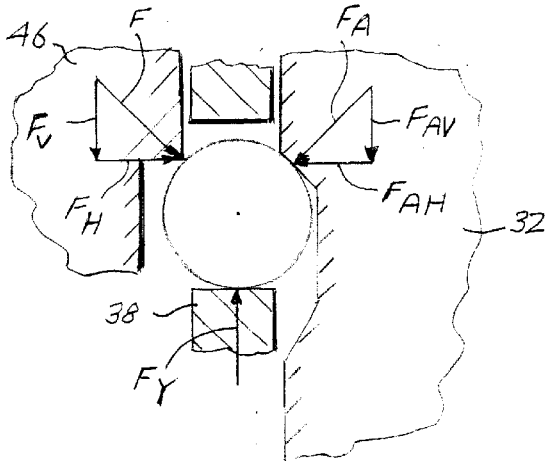

With reference to FIG. 11, when the lock is subjected to a rearward pulling force $F_Y$, rearward movement of the balls will be opposed by a reactionary force $F_A$, which again may be resolved into horizontal and vertical components $F_{AH}$ and $F_{AV}$. A state of equilibrium again continues as long as the horizontal component $F_{AH}$ of reactionary force $F_A$ is equal to $F_H$. When the pulling force $F_Y$ produces a horizontal reactionary force $F_{AH}$ that exceeds $F_H$, the locking balls 44 are retracted from the recess 60 into the barrel 38, allowing the barrel lock to be axially extracted from the collar 32.

Preferably, the angles $\alpha$ and $\beta$ of recess walls A and C are selected such that the externally applied axial force $F_Y$ necessary to extract the lock will exceed the force $F_X$ required to advance the lock from its unlocked position to its locked position. Most preferably, $F_Y$ will be between about 200 to 400% of $F_X$.

In light of the foregoing, it will now be appreciated by those skilled in the art that in the condition shown in FIG. 5, the lock 34 is securely assembled to the split retaining ring in its unlocked condition, requiring only a simple push to urge it forwardly to the locked position shown in FIG. 7. The manner in which the lock is assembled to the split ring is not critical to the achievement of this basic objective, and indeed other equivalent arrangements are possible and likely to be developed once the advantages of the present invention become known. For example, the internal recess 60 need not necessarily comprise a circular groove, but instead may comprise circumferentially spaced notches or the like. The angles $\alpha$ and $\beta$ of recess walls A and C may be varied to thereby alter the relationship of forces $F_X$ and $F_Y$.

The concepts of the present invention are suited for applications other than lock assemblies for split retainer rings.

Figure 12:
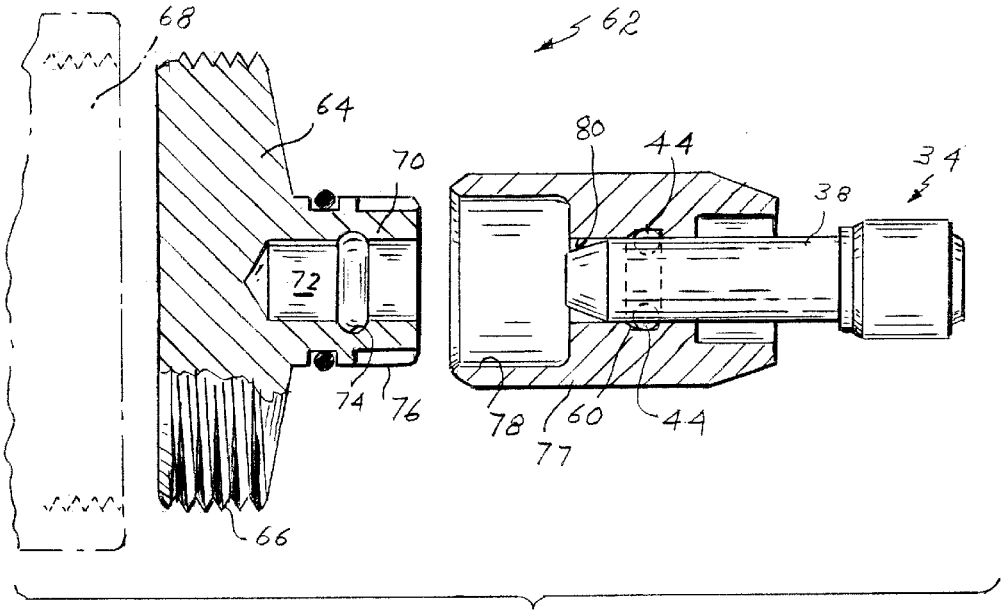
FIG. 12 is an longitudinal sectional view taken through a disassembled plug lock embodying the concepts of the present invention.
Figure 13:
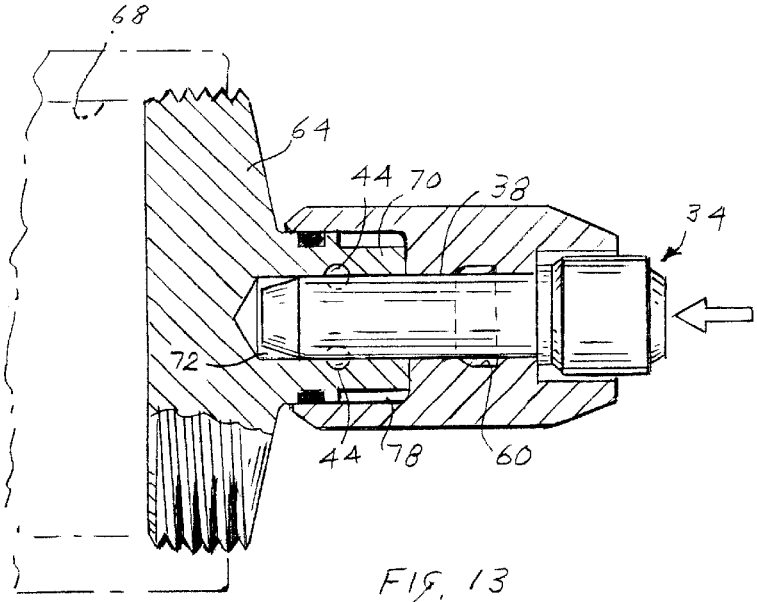
FIG. 13 is a view similar to FIG. 12 showing the plug lock components in an assembled and interlocked condition.

For example, FIGS. 12 and 13 illustrate the invention employed with a typical plug lock assembly generally depicted at 62. A plug 64 is threaded externally at 66 for installation into the internally threaded port 68 of a gas valve or the like. The plug has a collar 70 with a blind bore 72 internally grooved as at 74, and with external flats 76 engageable by a wrench (not shown) to tighten the plug in place. An outer cylindrical body 77 has an enlarged diameter chamber 78 at one end communicating with a reduced diameter stepped passageway 80 containing the barrel 38 of a barrel lock 34. The barrel lock is again retained in an unlocked position by the locking balls 44 releasably received in an internal recess 60 of the type previously described.

In use, the body 77 is seated on the plug 64 with the plug collar 70 received in chamber 78. The barrel lock is then pushed into its locked position as shown in FIG. 13, thereby retaining the plug and body in an assembled state, with the body being freely rotatable to thereby prevent unauthorized removal of the plug.

Although not shown, it will be understood that the same basic arrangement can be employed to secure a cap lock against unauthorized removal.

Figure 14:
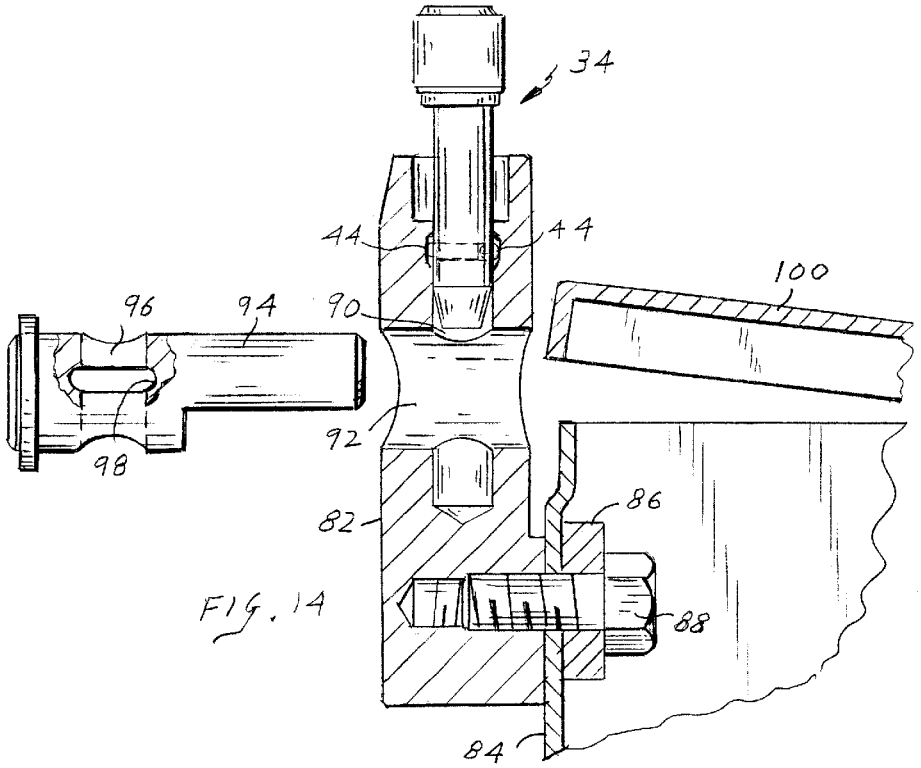
FIG. 14 is a partially exploded cross sectional view of a dead bolt assembly secured to the wall of a meter box adjacent to a partially open lid.
Figure 15:
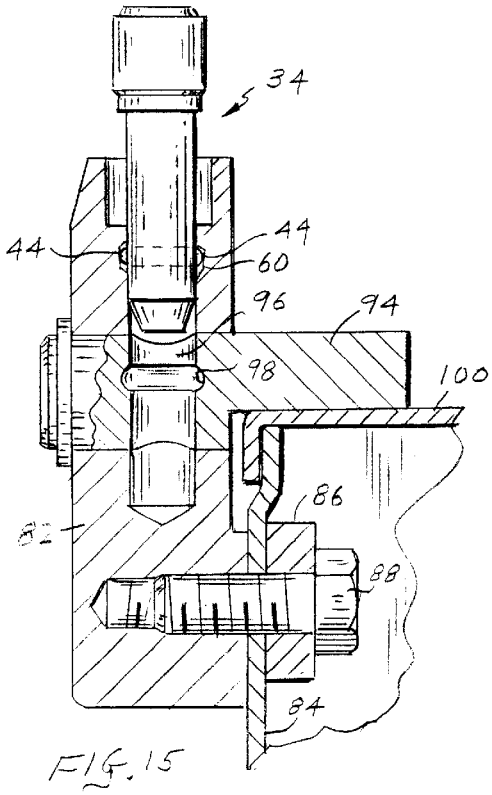
FIGS. 15 and 16 are views similar to FIG. 14 showing different stages in the assembly of the dead bolt components.
Figure 16:
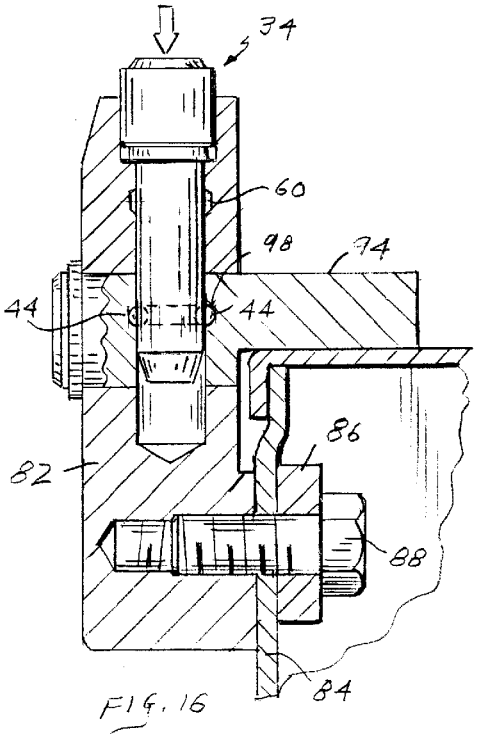

FIGS. 14–16 illustrate the invention employed with a dead bolt assembly. A body element 82 is secured to a sidewall 84 of a meter box by an internal locking plate 86 and bolt 88. The body element includes a vertical passageway 90 interrupted by a transverse through bore 92. A barrel lock 34 is again retained in an unlocked condition in the upper end of passageway 90 by the locking balls 44 releasably received in an internal recess 60 of the type described previously. A bolt 94 having a transverse bore 96 internally grooved as at 98 is configured and dimensioned to be received in and extend through the transverse bore 92 in body element 82.

When the lid 100 of the meter box is seated in its fully closed position on the upper rim of the side wall 84, the bolt 94 is inserted into its operative position as shown in FIG. 15 where it extends through the bore 92 to overlap the upper lid surface. Thereafter, as shown in FIG. 16, the barrel lock 34 is pushed downwardly into the bore 96 where its locking balls coact in interlocked engagement with the internal groove 98.

In summary, therefore, the present invention is to be viewed broadly to encompass not only the embodiments described in the foregoing text and illustrated in the accompanying drawings, but also all equivalent designs wherein the locking balls of a conventional barrel lock serve not only to retain the lock in its advanced locked position, but also to releasably retain the lock in a retracted unlocked position, from which it may be advanced by the application of an axially applied external force.

We claim:

1. A security device comprising:

a first component having a through first passageway surrounded by an internal first recess;

a second component having a second passageway surrounded by an internal second recess, said first and second components being configured for assembly in a mating relationship with said first and second passageways in communication and coaxial alignment; and a lock having a barrel containing a spring and plunger and carrying radially shiftable locking elements, said plunger being normally biased by said spring in one direction urging said locking elements into expanded positions protruding radially from said barrel, said barrel being insertable into and releasably retained in an unlocked position in said first passageway with said locking elements expanded radially outwardly into said first recess, said barrel being forwardly shiftable by a forwardly applied axial force into a locked position in said second passageway with said locking elements expanded into said second recess and being retractable from said unlocked position in said first passageway by a rearwardly applied axial force, said first recess having forward and rearward surfaces configured to coact with said locking elements in response respectively to said forwardly and rearwardly applied forces to exert reactionary forces urging said locking elements radially inwardly and urging said plunger in the opposite direction to accommodate retraction of said locking elements from said first recess.

2. The security device of claim 1 wherein said rearwardly applied force is greater than said forwardly applied force.

3. The security device of claim 1 or 2 wherein said first recess has a flat bottom extending from said forward surface to said rearward surface, and wherein said forward and rearward surfaces are inclined at different angles with respect to a reference plane perpendicular to said bottom.

* * * * *